United States Patent [19]

Hamada

[11] 4,410,174

[45] Oct. 18, 1983

[54] EXERCISE HORSE

[76] Inventor: Sadao Hamada, 2492 Battaglia Cir., San Jose, Calif. 95132

[21] Appl. No.: 362,110

[22] Filed: Mar. 26, 1982

[51] Int. Cl.[3] ..... A63B 5/12

[52] U.S. Cl. ..... 272/64; 206/315.1

[58] Field of Search ..... 272/63, 64, 93, 109; 190/1, 48; 224/151, 156; 206/315 B, 315 R; 273/285

[56] References Cited

U.S. PATENT DOCUMENTS

| | | | |
|---|---|---|---|
| 2,501,270 | 3/1950 | Fleming | 206/315 |
| 3,092,225 | 6/1963 | Kivett | 206/315 X R |

*Primary Examiner*—Richard C. Pinkham
*Assistant Examiner*—Stephen R. Crow
*Attorney, Agent, or Firm*—Philip M. Shaw, Jr.

[57] ABSTRACT

An exercise device comprised of a pair of hinged together, semicylindrical case halves which, when unfolded and placed on an exercise floor, constitute a pommel handle support and which, when folded together and latched, can be easily carried like a suitcase with the pommel handles stored inside.

6 Claims, 5 Drawing Figures

EXERCISE HORSE

BACKGROUND OF THE INVENTION

This invention relates to an exercise device, and more particularly to an exercise horse of the type used by gymnasts.

There are various gymnastic exercises that require the use of an exercise horse. Among these, are handstand, planche, press, double leg circles, an L, V etc. These exercises would normally be done on a pommel horse, parallel bars or still rings. All of these various gymnastic exercise devices are relatively expensive and heavy to transport. Nonetheless, it is often necessary for a gymnast to practice these various exercises not only in a gymnasium but also at home or on vacation. It is also desirable to run through some of these exercises as a warm-up exercise during a gymnastic meet.

There is, therefore, a need for a portable piece of gymnastic equipment upon which these various gymnastic exercises could be performed and which equipment would be lightweight and inexpensive to manufacture.

SUMMARY OF THE INVENTION

The present invention satisfies the above recited requirements for a piece of gymnastic equipment by providing an exercise horse which is portable. The exercise horse according to the invention comprises a pair of semicylindrically shaped case halves which are closed at their ends by arcuate pieces and which are hinged to each other by means of a piano type hinge attached along the bottom edges of separate end pieces of the two case halves.

Pommel handles are attached to the top curved surfaces of the case halves by means of bolts which pass through the handles, the case halves, and arcuate supports positioned within the curved hollow spaces of the case halves. The bolts are held in place by removable wing nuts.

For travelling, the pommel handles are removed and placed inside of the hollow spaces of one the case halves and the other case half is then folded over the first case half by means of the hinge and latched in place to, in effect, form a carrying case. A carrying handle attached to one of the end pieces of one of the case halves provides a means for conveniently carrying the collapsed exercise horse.

It is therefore an object of the present invention to provide a portable exercise horse.

It is another object of the invention to provide a lightweight exercise horse.

It is still a further object of the invention to provide an inexpensively manufactured exercise horse.

The novel features which are believed to be characteristic of the invention, both as to organization and method of operation, together with further advantages thereof, will be better understood from the following drawings, in which several preferred embodiments of the invention are illustrated by way of example.

DETAILED DESCRIPTION OF THE PREFERRED EMBODIMENT

Figure 1:
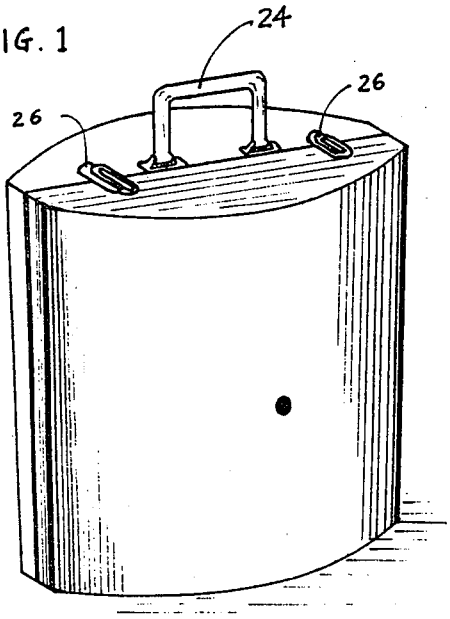
FIG. 1 is a perspective view of the exercise horse of the invention when collapsed for carrying.
Figure 2:
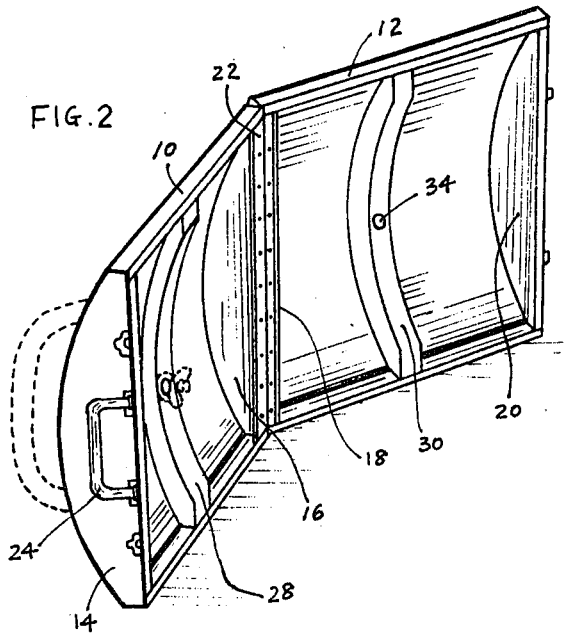
FIG. 2 is a perspective view illustrating the exercise horse of the invention when partially opened.

Referring now more particularly to FIGS. 1 and 2, a pair of semicylindrical case halves 10 and 12 are each provided with arcuate shaped end pieces 14 and 16 and 18 and 20, respectively. The two case halves 10 and 12 are hinged together by means of a piano type hinge 22 attached along bottom lower edges of the end pieces 16 and 18, as viewed in FIG. 2. The end piece 14 is provided with a carrying handle 24 and the end pieces 14 and 20 together are provided with suitable latches 26 for holding the two case halves 10 and 12 closed when the case halves are folded together for purposes of carrying the exercise horse.

Figure 3:
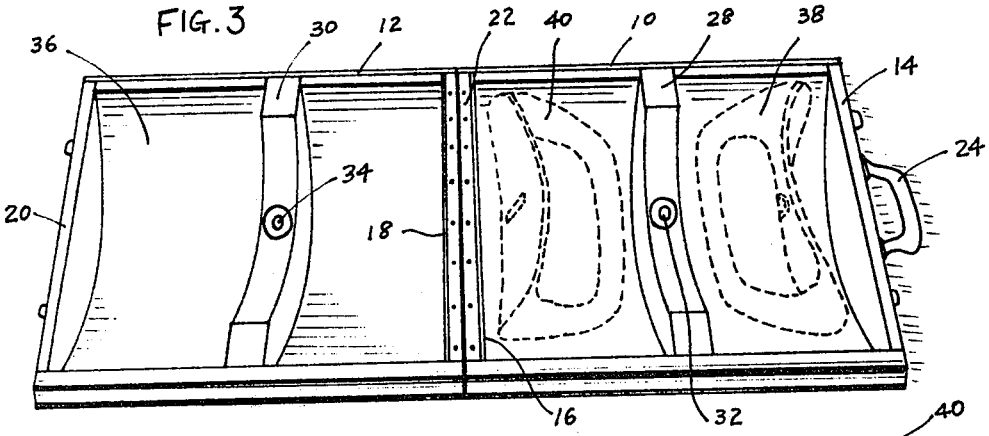
FIG. 3 is a perspective view illustrating the exercise horse when fully open and turned on its back.

Referring now more particularly to FIG. 3, each of the case halves 10 and 12 is provided with a center, arcuate shaped support 28 and 30, respectively. A hole 32 is bored through the center of the support 28 and out through the top surface of the case 10. Similarly, a second hole 34 is also bored through the center of the support 30 and out through the top surface of the case 12.

The inside hollow surfaces of the case halves 10 and 12 are provided with a foam layer which can either be foamed in place or be an adhesive backed layer of foam, 36. As illustrated in FIG. 3, the hollow spaces between the ends 14 and 16, for example, and the center support 32 are sufficiently large to accommodate a pair of standard sized pommel handles 38 and 40 when the two case halves 10 and 12 are folded in the closed position, shown in FIG. 1.

Figure 4:
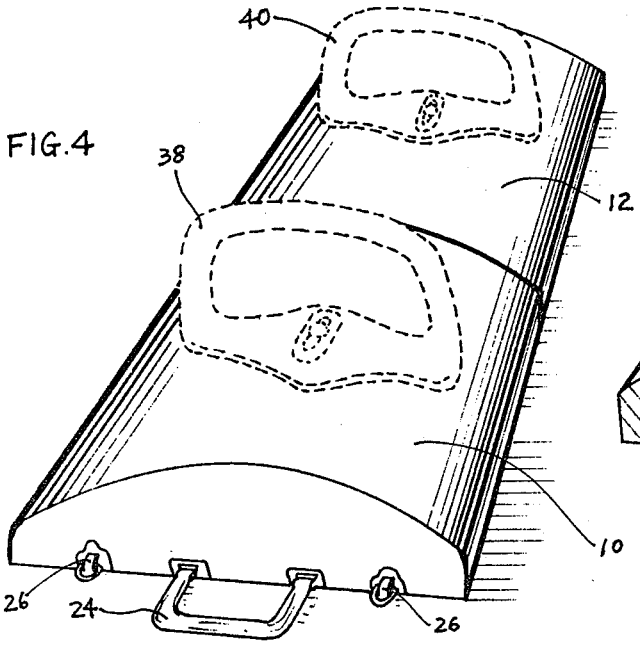
FIG. 4 is a perspective, end view illustrating the exercise horse of the invention when layed flat on an exercise floor.
Figure 5:
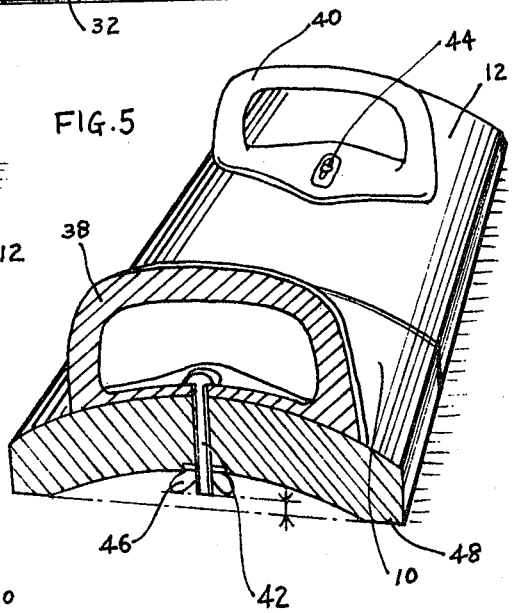
FIG. 5 is a perspective view, partly in section, illustrating the exercise horse of the invention when layed flat on an exercise surface together with attached pommel handles.

Referring now more particularly to FIGS. 4 and 5, the radius of curvature of the outside surfaces of the case halves 10 and 12 have the same curvature as that specified by the Federation of International Gymnastics for pommel horses. Thus, any pommel handle certified by the Federation for International Gymnastics will fit upon the surfaces. The pommel handles 38 and 40 are mounted by means of bolts 42 and 44 which pass through holes in the handles, the bores 32 and 34, and are secured in place by means of wing nuts and washer assemblies 46.

As best illustrated in FIG. 5, the bottom edges of the case halves 10 and 12 as well as the end edges of the center supports 28 and 30 are flattened at 48 to provide a suitable footing for the exercise horse upon the exercise surface or floor. While the various dimensions and the materials used to make the exercise horse are subject to questions of design and cost, the exercise horse can be made of any light and durable material, such as plastic, wood, aluminum metal, or the like. Furthermore, the outside curved surfaces can also be covered with similar such materials including aluminum sheet metal. It is important that the material chosen be strong, otherwise the horse could break or deform, thereby destroying the stability of the exercise horse. It is also important that the material not be too light, even though quite strong, as this would cause the user to loose stability and the horse to tip over. On the other hand, if the material chosen is too heavy, then the penalty which is paid is that the device becomes less portable.

Similar considerations have to be taken into account in the choice of dimensions. If the length and the width of the case halves 10 and 12 are too large, then the device becomes less portable. On the other hand, if they are chosen too small, the exercise horse will not be as stable. The dimensions are preferably chosen such that each case half 10 and 12 is between 12 and 24 inches in width, between 8 and 32 inches in length, and between 2 and 20 inches in height. Thus, the corresponding measurements of the exercise horse when folded would be 12 to 24 inches in width, 8 to 32 inches in length, and 4 to 40 inches in height. The unfolded length of both case halves together would thus be 16 to 64 inches in length. The case halves of the preferred embodiment of the invention have the dimensions of 17 inches in width by 17 inches in length by 3½ inches in height.

The terms and expressions which have been employed here are used as terms of description and not of limitation and there is no intention, in the use of such terms and expressions, of excluding equivalents of the features shown and described, or portions thereof, it being recognized that various modifications are possible within the scope of the invention as claimed.

What is claimed is:

1. A pommel handle exercise apparatus comprising a case made of two semicylindrical halves, each of the halves having an outer, convex surface and being hinged at one end to the other half, and further wherein each of the case halves being provided with a means for removably attaching pommel handles to the outer convex surface thereof, in an upright, rigid manner, whereby said handles may be removed and stored inside said case when not in use.

2. An exercise apparatus as defined in claim 1 wherein the case halves have a concave inner surface and a convex outer surface, the two concave inner surfaces facing each other when the case halves are closed together, and wherein each of the case halves has a pair of arcuately shaped end pieces for providing structural support and for closing off the hollow spaces when the case halves are closed together.

3. Exercise apparatus as defined in claim 1 wherein the means for attaching pommel handles comprises arcuately shaped center supports attached to the case halves on the side opposite from the outer, convex surface, the case halves and the center supports being provided with a center bore therethrough, and further including removable bolt means for attaching pommel handles to the case halves by passing through the pommel handles, the case halves and the center supports and for being threadably secured thereto.

4. Exercise apparatus as recited in claim 2 wherein the concave inner surfaces of said case halves are lined with foam.

5. Exercise apparatus as recited in claim 1 wherein the case halves, when opened and layed on a flat surface are each joined to the other at one end by means of a continuous hinge along the bottom end edge of the case halves.

6. Exercise apparatus as recited in claim 5 wherein the case halves, when opened and placed on a flat surface with their convex surfaces pointing upwards, are provided with a flattened bottom footing along the peripheral edge of the cases for supporting the case halves on the floor.

* * * * *